United States Patent [19]

Cordea et al.

[11] 4,409,027

[45] Oct. 11, 1983

[54] ALLOY STEEL FOR ROLL CASTER SHELL

[75] Inventors: James N. Cordea, Monroe, Ohio; Harshad V. Sheth, Rancho Palos Verdes, Calif.

[73] Assignee: Armco Inc., Middletown, Ohio

[21] Appl. No.: 393,192

[22] Filed: Jun. 28, 1982

[51] Int. Cl.[3] ..... C22C 38/44

[52] U.S. Cl. ..... 75/128 W; 75/128 V; 75/128 R; 148/36

[58] Field of Search ..... 75/128 R, 128 V, 128 W; 148/36

[56] References Cited

U.S. PATENT DOCUMENTS

| | | | |
|---|---|---|---|
| 2,022,192 | 11/1935 | Ferree | 148/36 |
| 2,673,147 | 3/1954 | Brezin | 148/36 |
| 2,921,849 | 1/1960 | Furgason | 75/128 V |

FOREIGN PATENT DOCUMENTS

| | | | |
|---|---|---|---|
| 54-26975 | 9/1979 | Japan | 75/128 W |

*Primary Examiner*—L. Dewayne Rutledge
*Assistant Examiner*—Debbie Yee
*Attorney, Agent, or Firm*—Frost & Jacobs

[57] ABSTRACT

Alloy steel having particular utility for roll caster shells used in the direct casting of molten aluminum to sheet, consisting essentially of from 0.50% to 0.60% carbon, about 0.40% to about 1.0% manganese, 0.10% to 0.30% silicon, about 0.02% maximum phosphorus, about 0.02% maximum sulfur, 0.40% to 0.90% nickel, 1.50% to 3.00% chromium, 0.80% to 1.20% molybdenum, 0.30% to 0.50% vanadium, and balance essentially iron. Caster shells fabricated from the steel exhibit markedly longer service life.

9 Claims, 2 Drawing Figures

ALLOY STEEL FOR ROLL CASTER SHELL

BACKGROUND OF THE INVENTION

This invention relates to an alloy steel for fabrication into roll caster shells used in the direct casting of molten aluminum to sheet, and to a roll caster shell made therefrom. The steel of this invention exhibits markedly longer service life than the standard prior art steel used for this purpose.

Molten aluminum is direct cast at a temperature of about 675° C. (1250° F.) to sheet thickness between pairs of water cooled roll caster shells. After a number of hours of operation conventional roll shell surfaces develop heat checks or cracks which gradually penetrate deeper into the shell, causing marks on the cast strip and eventually breaking the shell. Periodic shutdowns are thus necessary in order to remachine the shell surfaces and eliminate the cracks. Each remachining may remove about 15% of the thickness of the shell, and eventually the shells must be scrapped after production of about 5 to 8 million pounds of aluminum, under present practice. Typically a shell made from the standard alloy steel operates for about 300 to about 500 hours before the first surface remachining (representing about 1 million pounds of aluminum), which reduces the shell to about 85% of its original thickness. In contrast to this, the steel of the present invention can operate for about 1500 to 2000 hours (representing about 4.5 million pounds of aluminum) before the first remachining, and requires reduction only to about 95% of its original thickness. At least about 10 million pounds of sheet aluminum can be produced with the roll caster shells of the present invention before scrapping thereof.

The standard alloy steel now used for roll caster shells comprises, in weight percent, from 0.53% to 0.58% carbon, 0.45% to 0.65% manganese, 0.20% to 0.30% silicon, about 0.02% maximum phosphorus, about 0.02% maximum sulfur, 0.40% to 0.50% nickel, 1.0% to 1.2% chromium, 0.45% to 0.55% molybdenum, 0.10% to 0.15% vanadium and balance essentially iron.

The standard aluminum die casting die steel now used, designated as H-13, comprises, in weight percent, from 0.30% to 0.40% carbon, 0.20% to 0.40% manganese, 0.80% to 1.20% silicon, 4.75% to 5.50% chromium, 1.25% to 1.75% molybdenum, 0.80% to 1.20% vanadium, and balance essentially iron. This alloy can be used for roll caster shells, but it is expensive and can present processing difficulties.

Literature references relating to thermal fatigue, thermal cracking, high temperature alloys and alloying elements are as follows:

Glenny, E., "Thermal Fatigue," Metallurgical Reviews, 1961, Vol. 6, No. 24.

Sobolev, N. D. and Egoror, V. I., "Thermal Fatigue and Thermal Shock," *Strength and Deformation in Non-uniform Temperature Fields,* Edited by Ya. B. Fridman, Consultants Bureau, New York, 1964.

*High Temperature High Strength Alloys,* AISI Publication, No. 601, New York, February, 1963.

Benedyk, J. C. et. al., "Thermal Fatigue Behavior of Die Materials for Al Die Casting," Paper 111, 6th SDCE International Die Casting Congress, Cleveland, Ohio, Nov. 16–19, 1970.

Young, W., "Are You Getting Maximum Performance From Your Die Casting Dies?" ASTME Paper, CM 68-587, 1968.

Northcott, L., and Baron, H. G., "The Craze-Cracking of Metals," Jnl. of ISI, Dec. 1956.

Glenny, E., "Thermal Fatigue Resistance of Martensitic Steels," Jnl. of Matls., JMLSA, Vol. 4, No. 1, March 1969.

Rostoker, W., "*Thermal Fatigue Resistance of Martensitic Steels,*" Jnl. of Matls., JMLSA, Vol. 4, No. 1, March 1969.

Bain, E. C., and Paxton, H. W., *Alloying Elements in Steel,* ASM Publ., 1966.

Archer, R. S., et. al., *Molybdenum, Steels-Irons-Alloys,* Climax Molybdenum Co. Publ., N.Y., 1962.

*Vanadium, Steels and Irons,* Vanadium Corp. of America, N.Y., 1937.

SUMMARY OF THE INVENTION

During the direct casting of molten aluminum to sheet thickness on pairs of water cooled roll caster shells, rapid heating and cooling of the shell surfaces occur. As a result, significant stresses can be developed. If these stresses exceed the yield strength and are tensile in nature, heat checks or cracks are developed on the shell surfaces. It is generally agreed by those skilled in the art that heat checks of this type are formed by a thermal fatigue mechanism when cyclic yielding or plastic flow of the material occurs.

On start-up the surface of the roll caster shell is believed to be in tension because of the residual tensile stresses resulting from heat treatment and the shrink fit on the core. Although the magnitude of such stress is not known, it is assumed to be elastic, i.e. below the yield strength and hence insufficient to cause plastic damage. During the rapid heat-up in the casting operation, the surface of the shell attempts to expand but is held back by the bulk of the shell material below the surface. If the temperature differential is sufficiently great, the shell surface can exceed the yield strength in compression, and localized "buckling" of the material can occur. Upon cooling the surface will tend to contract back to its original dimensions but is restrained from doing so because of the compressive plastic deformation which occurred previously. With the drop in temperature, the tensile stress increases rapidly, exceeding the yield strength, and plastic flow occurs, probably in the valleys of the buckled areas. The plastic deformation per cycle contributes to the development of thermal fatigue cracks.

The total thermal strain ($\epsilon_t$) is derived from the equation $$\epsilon_t = \alpha \Delta T$$

where $\alpha$ is the coefficient of thermal expansion and $\Delta T$ is 1150° F. (maximum roll surface temperature of 1250° F. and minimum roll surface temperature of 100° F.).

The total strain is assumed to be composed of elastic and plastic components. The elastic component can be represented by the elevated temperature strength in tension divided by the elastic modulus. The plastic component of the total strain can be determined if an accurate estimate of the elastic component can be made. Such calculations are very useful because they provide a quantitative measure of physical properties necessary to reduce the onset of thermal fatigue and heat checking.

It has been recognized in the prior art that minimizing heat checking is empirically dependent upon control of such properties as coefficient of thermal expansion, thermal conductivity, elevated temperature yield strength, elevated temperature ductility and elevated temperature modulus of elasticity. More specifically, it has been believed that optimum results are obtained with a low coefficient of thermal expansion, high thermal conductivity, high elevated temperature yield strength, high elevated temperature ductility and low elevated temperature modulus of elasticity. Unfortunately, no known alloy system exhibits this combination of properties, and attempts to improve one of the properties in a particular alloy system usually results in the sacrifice of another. For example, an increase in yield strength typically results in a decrease in ductility in a steel alloy. Substitution of a copper base alloy would result in much higher thermal conductivity and a lower modulus of elasticity (both of which are desirable), but the coefficient of thermal expansion is high and the yield strength is low. Similar problems arise with respect to austentitic stainless steels.

The literature has reported that AISI Type 347 austenitic stainless steel and A-286 (an austenitic precipitation hardening steel) spall severely when exposed to molten aluminum less than 1000 times. A nickel base alloy (Waspaloy) was also reported to exhibit similar behavior. A molybdenum base alloy designated as TZM exhibited excellent properties but is prohibitive in cost.

A low coefficient of thermal expansion, a low modulus of elasticity at elevated temperature and a high yield strength are known to be beneficial, because the total thermal strain is reduced and a greater proportion of the strain occurs in the elastic range of the alloy. However, once plastic flow occurs, thermal fatigue damage is initiated, and thereafter the roll shell life is dependent on the inherent ductility of the material, its resistance to a potentially corrosive environment, and any superimposed mechanical fatigue cycle.

The present invention represents a discovery that an increase in elevated temperature yield strength of about 50% to 100% over that of the standard roll caster shell alloy steel composition surprisingly results in as much as a three-fold increase in service life, if the elevated temperature ductility is retained, despite the facts that the coefficient of thermal expansion and elevated temperature modulus of elasticity are not relatively low, and that the thermal conductivity is relatively low. It has been accepted in the prior art that the coefficient of thermal expansion and elevated temperature modulus of elasticity should be low and the thermal conductivity should be high, in order to minimize heat checking.

The increasing yield strength of the steel of the present invention thus unexpectedly overcomes or compensates for supposed deficiencies in other properties considered by those skilled in the art to be controlling in minimizing heat checking.

It is an object of the invention to provide an alloy steel having a minimum of expensive alloying elements which can be fabricated in conventional manner into roll caster shells having superior resistance to thermal fatigue.

According to the present invention, there is provided a ferritic alloy steel providing long service life in a roll caster shell used in the continuous casting of the molten aluminum, consisting essentially of, in weight percent, from 0.50% to 0.60% carbon, about 0.40% to about 1.0% manganese, 0.10% to 0.30% silicon, about 0.02% maximum phosphorus, about 0.02% maximum sulfur, 0.40% to 0.90% nickel, 1.50% to 3.00% chromium, 0.80% to 1.20% molybdenum, 0.30% to 0.50% vanadium, and balance essentially iron.

BRIEF DESCRIPTION OF THE DRAWING

Reference is made to the accompanying drawing wherein.

DETAILED DESCRIPTION OF THE INVENTION

Figure 1:
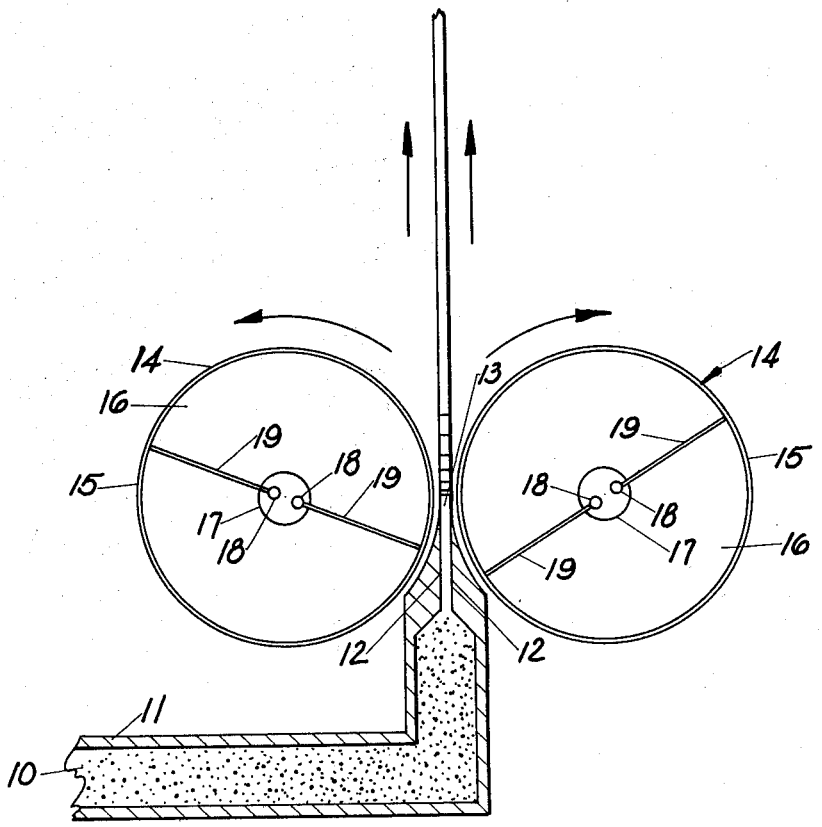
FIG. 1 is a diagrammatic vertical sectional view of an aluminum strip caster illustrating water cooled roll caster shells.

Referring to FIG. 1, a representative type of vertical caster for molten aluminum is shown. Molten aluminum is maintained at a constant level in a headbox (not shown) positioned in such manner that the molten metal, indicated at 10, flows by gravity into a distribution box indicated at 11 in which it is directed upwardly through a lip assembly 12 into a freezing zone 13. A pair of water-cooled rolls, indicated generally at 14, is provided which are driven in counter-rotating directions as shown by arrows in FIG. 1. The bite of rolls 14 is slightly above the freezing zone 13, so that the molten aluminum solidifies just before reaching the bite of the rolls and is hot rolled as it passes therebetween.

Each caster roll 14 comprises a roll shell 15 which is a forged, heat treated hollow cylinder fabricated from alloy steel. A core 16 is provided on which the outer shell 15 is mounted by a shrink fit, i.e. the shell is heated, causing it to expand, and is slipped over the core. The shell then shrinks upon cooling to fit tightly around the core. An axial drive shaft is indicated at 17 which is provided with cooling water conduits indicated at 18. A plurality of radial tubes indicated at 19 is provided communicating with conduits 18 to conduct cooling water outwardly to the inner surface of the shell 15.

A caster of the type described above is known in the art, and the present invention relates only to the outer roll caster shell 15 thereof.

Caster shells for this application are typically electric furnace, air melted heats. They are cast into ingots, soaked at temperatures of about 1225° C., pierced and open die forged on a mandrel to tubes 600 mm to 1000 mm in diameter. They are subsequently austenitized at 870° C., followed by an oil quench and tempering to the desired strength level. The steel of the present invention is processed in this manner.

As indicated hereinabove the ferritic alloy steel of the present invention has been found to prolong the service life of roll caster shells of the type illustrated in FIG. 1 by at least 100% and as much as 300% under optimum conditions, by reason of the relatively high yield strength and ductility of the steel at elevated temperature.

The percentage ranges of carbon, silicon, chromium, molybdenum and vanadium, and the balancing therebetween are critical, and departure therefrom results in a loss of the combination of high yield strength and ductility at elevated temperature. To a lesser extent the nickel range is also critical.

Carbon is present in order to provide hardness and strength necessary for thermal fatigue resistance at high temperatures. A minimum of 0.50% is necessary for this purpose, while a maximum of 0.60% is observed in order to avoid thermal cycling above and below the $A_3$ temperature. It has been found that if the range of temperature fluctuations includes a phase change, an increase in the carbon content can increase the degree of thermal fatigue cracking. Carbon is maintained within the range of 0.50% to 0.60%, and preferably from about 0.53 to about 0.58%, in order to ensure adequate strength which is believed to result from its distribution in the microstructure of the steel and resistance to localized softening.

Silicon is generally present in steel since it is used as a primary deoxidizer. Although silicon is soluble in ferrite in amounts up to about 1% and provides increased strength, silicon is restricted to a maximum of 0.30%, and preferably about 0.20%, in the steel of the present invention in order to avoid a decrease in plasticity and the possibility of silicate inclusions at grain boundaries.

Chromium is essential in order to confer strength and oxidation resistance at elevated temperature. Its carbide-forming tendency increases the elevated temperature strength of carbon steels up through about 700° C. Chromium also has a tendency to raise the eutectoid temperature, thereby stabilizing the ferrite to higher temperatures. In the steel of the invention the above benefits are obtained by chromium additions within the range of 1.50% to 3.00%. An increase above 3.00% is undesirable since it would tend to reduce ductility and increase the cost. Preferably chromium ranges from about 1.90% to about 2.30%.

Molybdenum is also a strong carbide-forming element and high temperature strength is increased thereby. Molybdenum raises the eutectoid temperature and counteracts temper embrittlement during heat treatment of the steel. For these reasons a minimum of 0.80% molybdenum is required, and a maximum of 1.20% is observed since a loss in impact toughness may occur at higher levels. A molybdenum range of about 0.90% to about 1.10% is preferred.

Vanadium is also a carbide former and is added for the purpose of increasing the elevated temperature strength. Vanadium in solution has a marked effect on hardenability, and a mininum of 0.30% is required for these reasons. A maximum of 0.50% and preferably about 0.35% is observed since levels in excess thereof may adversely affect impact toughness.

Nickel is required within the range of 0.40% to 0.90% in order to promote toughness, thereby balancing the tendency of chromium, molybdenum and vanadium toward decreasing toughness. A maximum of 0.90% is desired in order to avoid the tendency of nickel to retain austenite after quenching and to minimize cost. A range of about 0.45% to about 0.55% nickel is preferred.

A manganese range of about 0.40% to about 1.00% is desirable for hardenability, formation of manganese sulfides and deoxidation. Levels above 1.00% would tend to increase the tendency toward heat checking or cracking because of the austenite stabilizing tendency of manganese after heat treatment and quenching, and a maximum of 0.70% is preferred.

Phosphorus and sulfur are ordinarily present as residual elements, and each should be restricted to a maximum of about 0.02% in order to avoid embrittlement and an increased tendency toward formation of heat checks or cracks.

Other carbide-forming elements such as tungsten, columbium and titanium could be added to the steel of the present invention as partial substitutes for molybdenum or vanadium in amounts not exceeding about 0.2% each. As is the case with molybdenum and vanadium excessive amounts of tungsten, columbium and/or titanium would adversely affect ductility and impact toughness.

A preferred steel of the invention thus consists essentially of, in weight percent, from about 0.53% to about 0.58% carbon, about 0.40% to about 0.70% manganese, 0.10% to about 0.20% silicon, about 0.02% maximum phosphorus, about 0.02% maximum sulfur, about 0.45% to about 0.55% nickel, about 1.90% to about 2.30% chromium, about 0.90% to about 1.10% molybdenum, 0.30% to about 0.35% vanadium, and balance essentially iron.

It will be understood that any one or more of the preferred ranges above can be used with any one or more of the broad ranges for the remaining elements indicated above.

If the stresses are greater than the yield strength and tensile in nature, heat checks or cracks will be produced by a thermal fatigue mechanism when cyclic yielding or plastic flow occurs. A hysteresis loop can be plotted representing the accumulation of plastic damage during each cycle for the circumferential stresses perpendicular to the longitudinal cracks in the roll shell surface. In prior art chromium-molybdenum steels the number of cycles to failure is about $10^4$ if the extent of plastic deformation per cycle is about 0.01 inch per inch or slightly less.

In the equation set forth above for total thermal strain ($\epsilon_t$), wherein the total strain is assumed to be the sum of elastic and plastic components.

$$\epsilon_t = \epsilon_{Elastic} + \epsilon_{Plastic} = \frac{\sigma y}{E} + \epsilon_{Plastic}$$

where $\theta y$ is the yield strength in tension and E is the elastic modulus. Thus, the elastic component of the strain is represented by the yield strength in tension divided by the elastic modulus. In the case of a steel having a yield strength of 200,000 psi at room temperature $$\epsilon_{Elastic} = \frac{\sigma y}{E} = \frac{200{,}000 \text{ psi}}{30.8 \times 10^6 \text{ psi}} = 6.49 \times 10^{-3} \text{ in/in.}$$

If the yield strength decreases by 50% at elevated temperature (such as 650° C.)

$$\epsilon_{Elastic} = \frac{100{,}000 \text{ psi}}{24 \times 10^6 \text{ psi}} = 4.16 \times 10^{-3} \text{ in/in.}$$

Where $\epsilon_t$ is equal to or greater than twice the elastic strain ($\epsilon_{Elastic}$), to account for the compression and tension portion of the elastic reaction, then plastic flow is possible in both the compression and tension ends of the cycle. With a 50% decrease in yield strength to 100,000 psi, $2\times\epsilon_{Elastic}=2\times4.16\times10^{-3}=8.32\times10^{-3}$ in/in. then the plastic component becomes $\epsilon_{Plastic}=\epsilon_t-2\times\epsilon_{Elastic}=8.0\times10^{-4}$ in/in.

Consequently, a plastic flow of about 0.001 inch per inch per cycle is possible, which would indicate a potential exhaustion of plasticity and failure in $10^4$ to $10^5$ cycles.

Although not intending to be bound by theory, the above calculations support applicants' belief that the high elevated temperature yield strength of the steel of the invention causes a much greater percentage of the thermal expansion and contraction to occur in the elastic region. This minimizes the plastic reaction and results in much greater resistance to heat checking. Maintenance of the high ductility of the steel at a higher yield strength insures a regarded crack growth rate once heat checking does occur.

Figure 2:
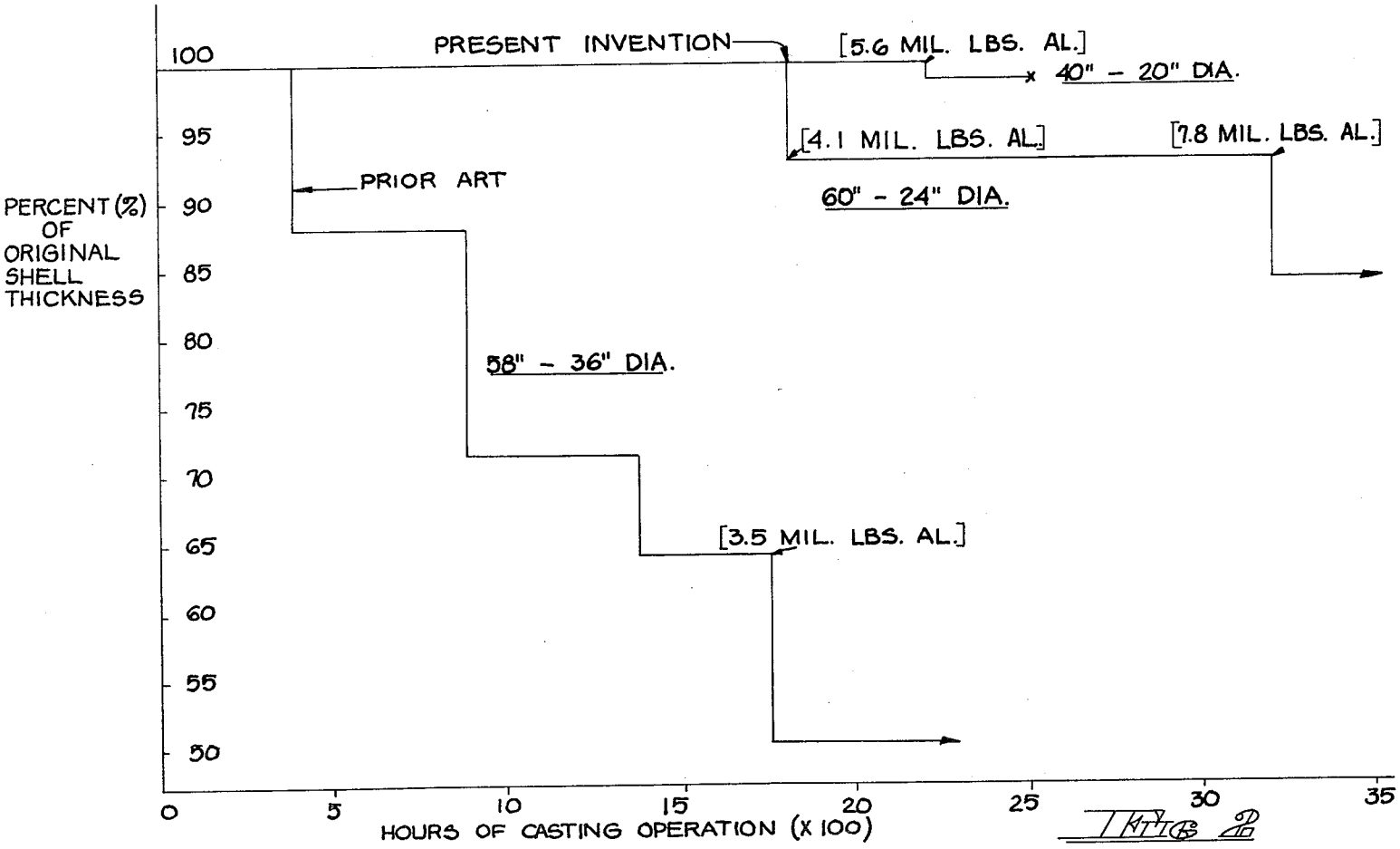
FIG. 2 is a graphic comparison of the service life of roll caster shells of the invention with those of the prior art, based on representative tests.

Compositions of two conventional steels now used for roll caster shells and two preferred steels of the invention are set forth in Table I. The elevated temperature mechanical properties (at 650° C.) of the steels of Table I are compared in Table II. All samples were heat treated by austenitizing at about 870° C., oil quenched and tempered. It is evident that the yield strengths of alloys 3 and 4 (steels of the invention) ranged from about 50% to about 100% higher than those of the prior art steels, yet the ductility of the steels of the invention, as measured by percent elongation in 5 cm and percent reduction in area, was at least equal to that of the prior art steels. The variation in yield & tensile strengths of steels 3 and 4 at elevated temperature is within the range normally to be expected. A 50% to 100% increase in yield strength at 650° C. can result in at least a 100% increase in service life, as shown by the graph of FIG. 2 from which it is evident that a shell fabricated from a prior art steel has been remachined several times down to 50% of its original thickness between 1500 hours and 2000 hours of casting operation. In contrast to this, experimental shells fabricated from a steel of the present invention have been remachined only to about 85% of original thickness at 3500 hours of casting operation. Further remachining down to the same level of 50% of original shell thickness (as in the case of the prior art steel) would be expected to permit at least about 5000 hours of casting operation before scrapping, which would represent at least about 10 million pounds of sheet aluminum production.

It is therefore believed to be demonstrated that the ferritic alloy steel of the present invention provides a relatively low cost product which can be fabricated in conventional manner by forging and heat treatment into a tubular roll caster shell which will result in at least a 100% and as much as a 300% increase in service life.

Modifications may be made in the invention without departing from the spirit and scope thereof, and it will be understood that all matter described herein is to be interpreted as illustrative and not as a limitation.

TABLE I

| | Compositions in Weight Percent | | | | | | | | |
|---|---|---|---|---|---|---|---|---|---|
| Alloy | C | Mn | Si | P | S | Ni | Cr | Mo | V |
| 1-Prior Art | 0.55 | 0.61 | 0.23 | — | — | 0.47 | 1.12 | 0.42 | 0.13 |
| 2-Prior Art | 0.51 | 0.56 | 0.32 | 0.004 | 0.003 | 0.45 | 1.13 | 0.54 | 0.16 |
| 3-Pres. Inv. | 0.57 | 0.49 | 0.13 | 0.014 | 0.015 | 0.47 | 2.03 | 1.00 | 0.33 |
| 4-Pres. Inv. | 0.54 | 0.54 | 0.13 | 0.014 | 0.013 | 0.48 | 2.13 | 1.01 | 0.34 |

TABLE II

| | Mechanical Properties at 650° C. | | | | | |
|---|---|---|---|---|---|---|
| | 0.2% Yield Strength | | Tensile Strength | | % Elong. | |
| Alloy | (ksi) | (MPa) | (ksi) | (MPa) | in 5 cm | % R.A. |
| 1-Prior Art | 31.9 | 220 | 49.4 | 341 | 40 | 94 |
| 2-Prior Art | 28.2 | 195 | 47.0 | 324 | 55 | 98 |
| 3-Pres. Inv. | 68.8 | 475 | 89.0 | 614 | 47 | 94 |
| 4-Pres. Inv. | 45.8 | 316 | 67.6 | 466 | 52 | 95 |

We claim:

1. A ferritic alloy steel consisting essentially of, in weight percent, from about 0.53% to about 0.58% carbon, about 0.40% to about 1.0% manganese, 0.10% to about 0.20% silicon, about 0.02% maximum phosphorus, about 0.02% maximum sulfur, about 0.45% to about 0.55% nickel, 1.50% to 3.00% chromium, 0.80% to 1.20% molybdenum, 0.30% to 0.50% vanadium, and balance essentially iron.

2. The steel claimed in claim 1, consisting essentially of from about 0.53% to about 0.58% carbon, about 0.40% to about 0.70% manganese, 0.10% to about 0.20% silicon, about 0.02% maximum phosphorus, about 0.02% maximum sulfur, about 0.45% to about 0.55% nickel, about 1.90% to about 2.30% chromium, about 0.90% to about 1.10% molybdenum, 0.30% to about 0.35% vanadium, and balance essentially iron.

3. The steel claimed in claim 1, exhibiting a 0.2% yield strength of at least 45 ksi (310 MPa) and an elongation in 5.08 cm of at least 40% at 650° C., when in the hot reduced and heat treated condition.

4. The steel claimed in claim 3, having high resistance to heat cracking when exposed to repeated thermal cycling between about 40° and about 675° C.

5. The steel claimed in claim 1, consisting essentially of about 0.55% carbon, about 0.6% manganese, about 0.15% silicon, about 0.02% maximum phosphorus, about 0.02% maximum sulfur, about 0.5% nickel, about 2.1% chromium about 1.0% molybdenum, about 0.32% vanadium and balance essentially iron.

6. A roll caster shell for use in the continuous casting of aluminum, comprising a forged, heat treated tube fabricated from a ferritic alloy steel consisting essentially of, in weight percent, from 0.53% to 0.58% carbon, about 0.40% to about 0.70% manganese, 0.10% to 0.20% silicon, about 0.02% maximum phosphorus, about 0.02% maximum sulfur, 0.45% to 0.55% nickel, 1.90% to 2.30% chromium, 0.90% to 1.10% molybdenum, 0.30% to 0.35% vanadium, and balance essentially iron.

7. The shell claimed in claim 6, having a service life in excess of 3500 hours.

8. The shell claimed in claim 6, having resistance to heat cracking when exposed to repeated thermal cycling between about 40° and about 675° C. such that remachining of the surface thereof is not required in less than about 1500 hours.

9. The shell claimed in claim 6, wherein said steel consists essentially of about 0.55% carbon, about 0.6% manganese, about 0.15% silicon, about 0.02% maximum phosphorus, about 0.02% maximum sulfur, about 0.5% nickel, about 2.1% chromium, about 1.0% molybdenum, about 0.32% vanadium, and balance essentially iron.

* * * * *